US006485349B1

(12) United States Patent
Snyder et al.

(10) Patent No.: US 6,485,349 B1
(45) Date of Patent: Nov. 26, 2002

(54) ROLLING TOY

(75) Inventors: Carol Snyder, East Aurora, NY (US); Domenic T. Gubitosi, East Aurora, NY (US); Christopher J. Hayes, West Falls, NY (US); Joseph E. Hoppy, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/854,928

(22) Filed: May 15, 2001

(51) Int. Cl.[7] ..... A63H 29/08

(52) U.S. Cl. ..... 446/168; 446/397; 446/227

(58) Field of Search ..... 446/168, 173, 446/175, 269, 270, 438, 439, 448, 227, 297; 473/570, 571; 273/123 R, 124 A, 118 A

(56) References Cited

U.S. PATENT DOCUMENTS

| | | | | |
|---|---|---|---|---|
| 1,150,761 A | * | 8/1915 | Hartman | 273/112 |
| 1,252,158 A | * | 1/1918 | Okel | 273/120 R |
| 3,028,704 A | * | 4/1962 | Rumbaugh | 273/112 |
| 3,849,931 A | | 11/1974 | Gulley, Jr. | |
| 4,175,665 A | * | 11/1979 | Dogliotti | 211/59.2 |
| 4,310,987 A | | 1/1982 | Chieffo | |
| 4,344,346 A | | 8/1982 | Erickson et al. | |
| 4,588,387 A | | 5/1986 | Swenson | |
| 4,595,369 A | | 6/1986 | Downs | |
| 4,701,146 A | | 10/1987 | Swenson | |
| 4,720,283 A | * | 1/1988 | Williams et al. | 446/168 |
| 4,737,134 A | | 4/1988 | Rumsey | |
| 4,757,491 A | | 7/1988 | Koike | |
| 4,844,447 A | | 7/1989 | McKnight | |
| 4,861,309 A | * | 8/1989 | Williams et al. | 446/168 |
| 4,934,079 A | | 6/1990 | Hoshi | |
| 4,968,877 A | | 11/1990 | McAvinney et al. | |
| 5,081,896 A | | 1/1992 | Hiyoshi et al. | |
| 5,108,340 A | | 4/1992 | Farrow | |
| 5,138,535 A | | 8/1992 | Aragon, Jr. | |
| 5,158,492 A | | 10/1992 | Rudell et al. | |
| 5,214,232 A | | 5/1993 | Iijima et al | |
| 5,216,193 A | | 6/1993 | Masubuchi | |
| 5,221,225 A | | 6/1993 | Newbold et al. | |
| 5,304,084 A | | 4/1994 | Liao | |
| 5,358,241 A | * | 10/1994 | Anghelo et al. | 273/118 R |
| 5,668,333 A | | 9/1997 | Horton et al. | |
| 5,683,164 A | | 11/1997 | Chien | |
| 5,720,644 A | | 2/1998 | Ku | |
| 6,142,849 A | | 11/2000 | Horton et al. | |

FOREIGN PATENT DOCUMENTS

| | | | |
|---|---|---|---|
| CH | 625710 A5 | * | 10/1981 |
| EP | 0 902 942 B1 | | 3/1999 |

OTHER PUBLICATIONS

Dichristin and Kirschner, "What's New", pp. 8–9, Popular Science Magazine, Feb. 1996.

* cited by examiner

*Primary Examiner*—Jacob K. Ackun
*Assistant Examiner*—Bena B. Miller
(74) *Attorney, Agent, or Firm*—Cooley Godward LLP

(57) ABSTRACT

A rolling toy having a tubular assembly with a helical ridge that guides movement of a ball within the tubular assembly when the toy is rolled.

28 Claims, 4 Drawing Sheets

ROLLING TOY

BACKGROUND OF THE INVENTION

1. Field of the Invention

The present invention relates to toys and, more particularly, to toys that a child may roll.

2. Description of the Related Art

Infant's toys are typically designed to promote intellectual and physical growth. Some are designed to encourage infants to crawl. Nevertheless, many of these toys fail to keep the interest of infants, often because they lack sufficient visual or audio stimuli.

SUMMARY OF THE INVENTION

Generally speaking, the embodiments of the present invention strive to provide a toy that will encourage an infant to crawl and develop motor skills.

Other advantages and features associated with the present invention will become more readily apparent to those skilled in the art from the following detailed description. As will be realized, the invention is capable of other and different embodiments, and its several details are capable of modification in various obvious aspects, all without departing from the invention. Accordingly, the drawings and the description are to be regarded as illustrative in nature, and not limitative.

DETAILED DESCRIPTION OF THE PREFERRED EMBODIMENTS

FIGS. 1–6 illustrate one embodiment of a rolling toy 100 in accordance with the present invention. As described further below, the rolling toy 100 encourages an infant to crawl by enticing the infant to roll the toy along a surface. The rolling toy 100 also encourages the development of motor skills when an infant inserts one or more balls 102 into the rolling toy via a passageway 122, removes one or more of the balls from the rolling toy via the passageway, and watches lights and hears sounds in response to these actions.

Figure 1:
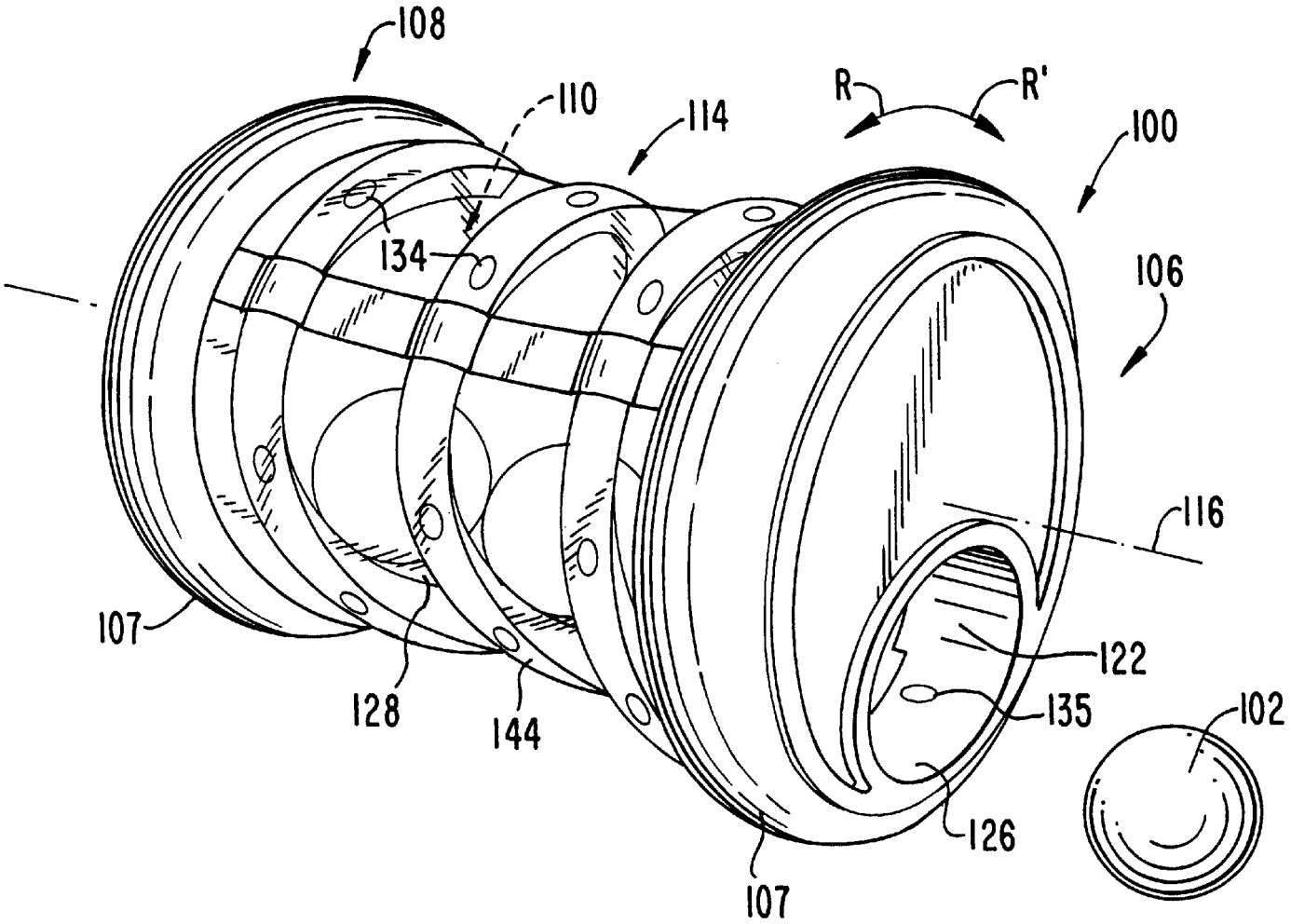
FIG. 1 is a perspective view of a rolling toy in accordance with one embodiment of the invention.
Figure 2:
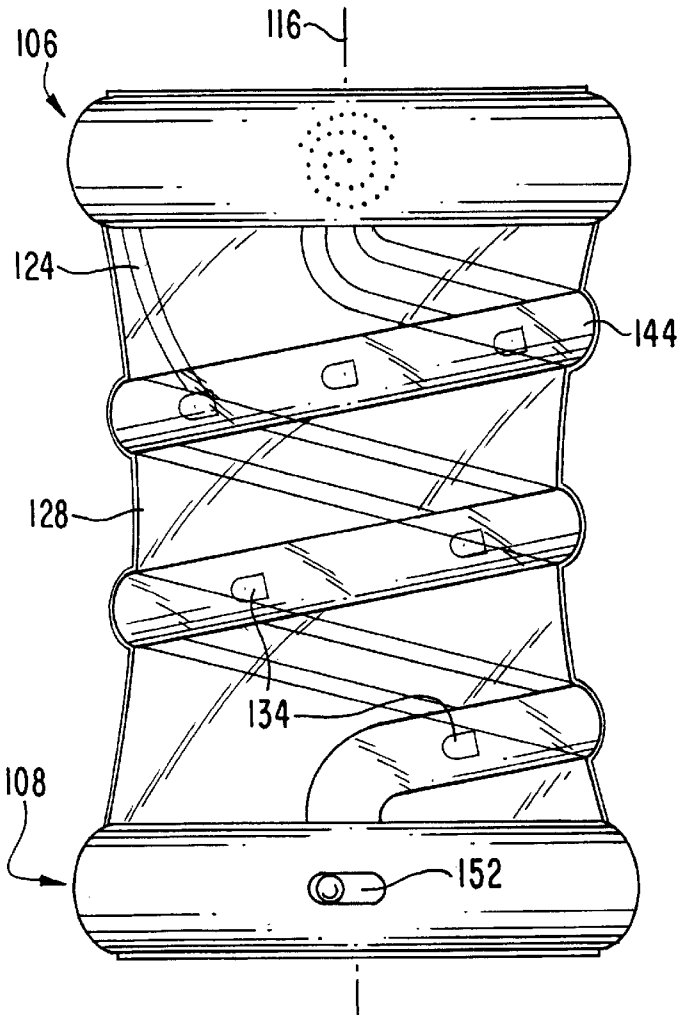
FIG. 2 is a side view of the rolling toy illustrated in FIG. 1.
Figure 4:
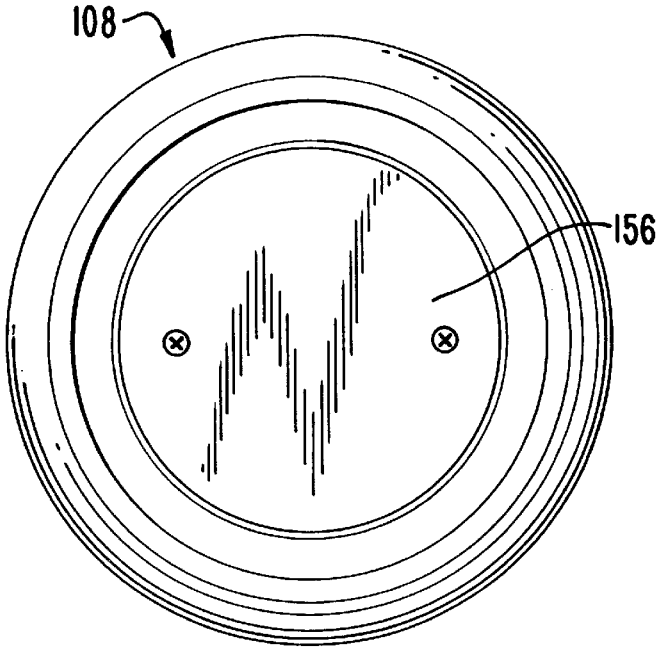
FIG. 4 is a top view of the rolling toy illustrated in FIG. 1.
Figure 5:
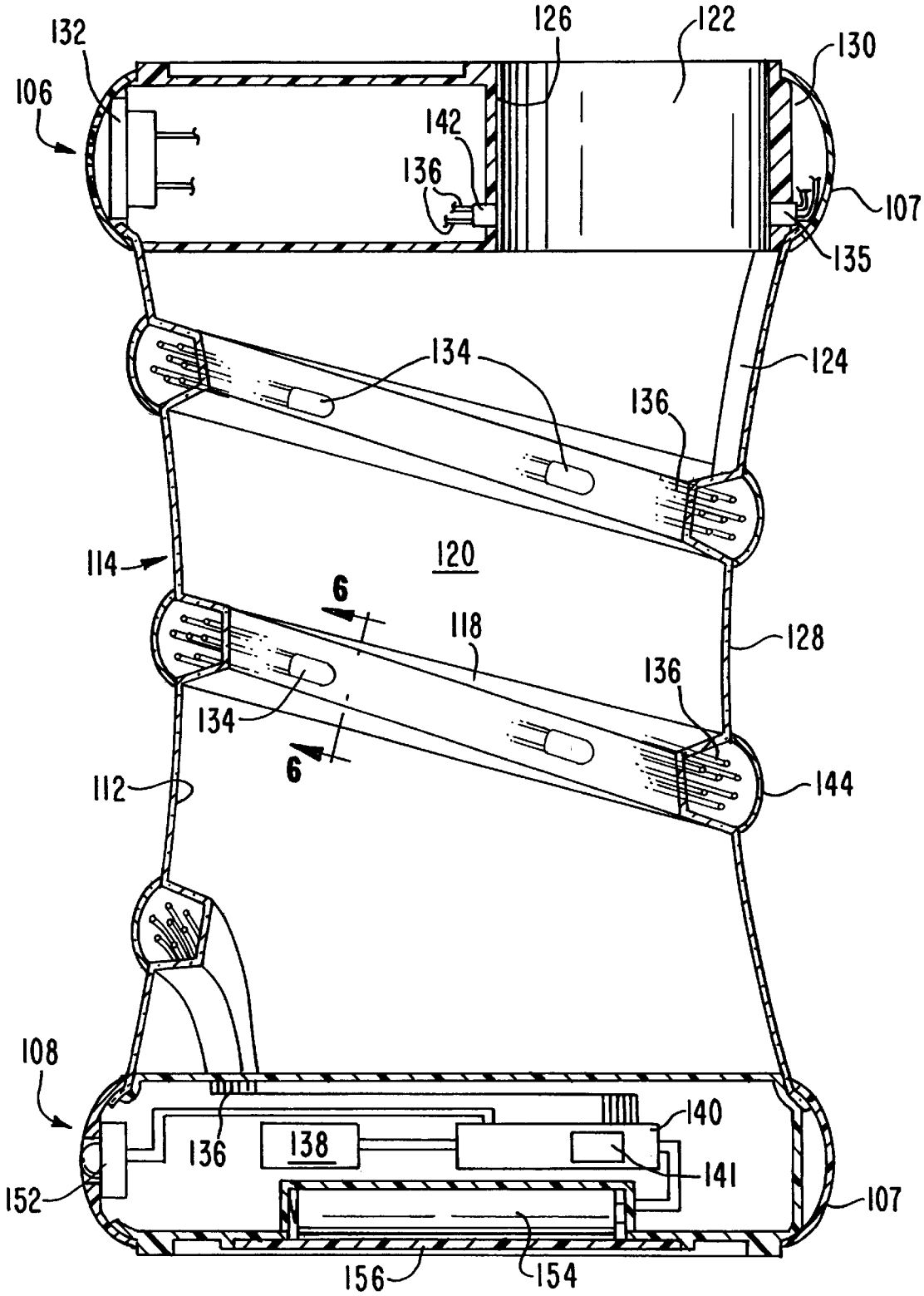
FIG. 5 is a cross-sectional view of the rolling toy illustrated in FIG. 1, taken along the line 5—5 in FIG. 3.

As illustrated in FIG. 1, the rolling toy 100 is defined by a tubular assembly having a first end 106, a second end 108, and a tubular portion 114 located between the first end and the second end. As is illustrated in FIGS. 1, 2, and 5, the tubular portion 114 is a hollow and elongated body and thus includes an interior area 110 that is at least partially defined by an interior surface 112. The interior surface 112 faces the interior area 110 and defines a surface along which the balls 102 roll and slide when the rolling toy 100 is rolled along a surface. The first end 106 is closed-off to such an extent that the balls 102 within the interior area 110 are prevented from exiting the interior area 110 except through a passageway 122 passing through a wall or housing 130 of the end 106 and having a peripheral surface 126 large enough to permit only one of the balls 102 to pass therethrough. The second end 108 is closed-off to prevent the balls 102 within the interior area 110 from exiting at the second end. Hence, the balls 102 may only enter and exit the interior area 110 via the passageway 122.

In the preferred embodiment, the peripheral surface 126 of the passageway 122 is ovally shaped and is located tangential with respect to the interior surface 122. In an alternative embodiment, the peripheral surface 126 of the passageway 122 is a circular cylinder. In yet a further embodiment, the first end 106 is not closed off and the passageway 122 is defined by an open end of the tubular portion 114. Alternative embodiments may also include another passageway 122 in the second end 108 such that the rolling toy 100 includes two passageways through which the balls 102 may exit and enter the interior area 110.

The first end 106 and the second end 108 each have a surface 107 that defines a rim for rolling the rolling toy 100. Each surface 107 has a diameter that is greater than an outermost circumference of the tubular portion 114 located between the first end 106 and the second end 108 such that the surfaces 107 contact and roll along a surface upon which the rolling toy 100 is located. In an alternative embodiment, the rolling toy 100 is configured to roll along an exterior surface 128 of the tubular portion 114.

Figure 3:
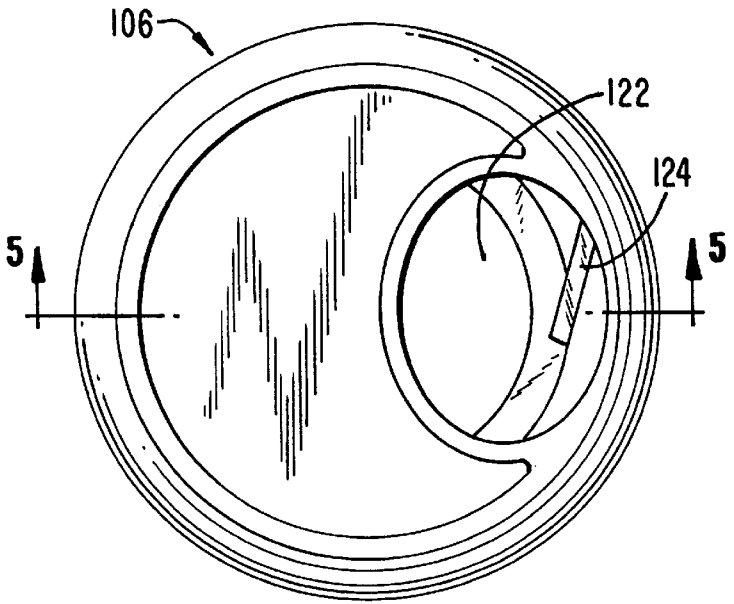
FIG. 3 is a top view of the rolling toy illustrated in FIG. 1.

As is apparent from FIGS. 1, 3, and 5, in the illustrated embodiment, the tubular portion 114 is not a right circular cylinder. Rather, the diameters of cross-sections of the tubular portion 114 (each measured along a plane transverse to a longitudinal center axis 116 of the tubular portion) increase non-linearly in each direction away from the longitudinal midpoint of the tubular portion 114. Alternative embodiments of the toy 100 include differently shaped tubular portions 114. For example, the tubular portion 114 may be a right circular cylinder, a truncated cone, or other shapes. Although other configurations will suffice, in the preferred embodiment, the tubular portion 114 is defined by two separate halves of transparent plastic that have been attached to each other with a plastic retainer.

Figure 6:
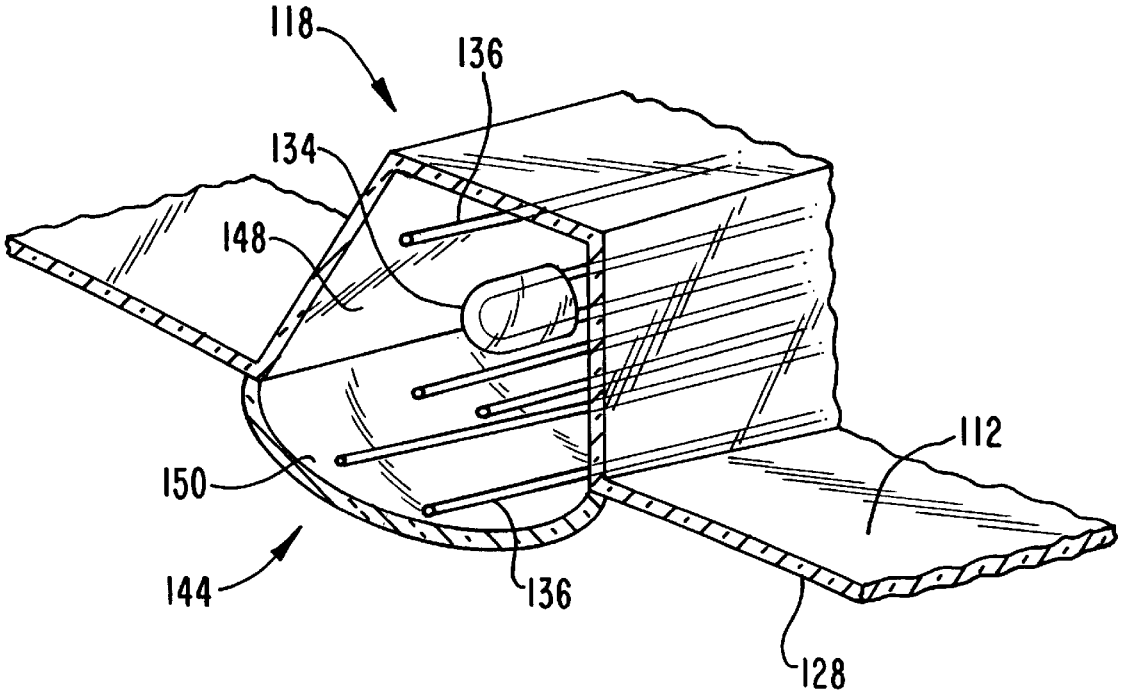
FIG. 6 is cross-sectional view of the helical ridge of the rolling toy illustrated in FIG. 1, taken along the line 6—6 in FIG. 5.

As illustrated by FIGS. 5 and 6, the rolling toy 100 also includes a helical ridge 118 that is raised from the interior surface 112. The helical ridge 118 coils or winds around the circumference of the interior surface 112 so as to guide the ball 102 within the interior area 110 away from the first end 106 when the ball moves along the interior surface 112 and the rolling toy 100 is rolled about the axis 116 in a first rotational direction R, and also so as to guide the ball 102 toward the first end 106 when the ball moves along the interior surface 112 and the rolling toy 100 is rolled about the axis 116 in a second rotational direction R' opposite from the first rotational direction. Hence, the helical ridge 118 is raised sufficiently enough from the interior surface 112 such that a ball 102 within the interior area 110 will roll or slide along the ridge 118 when the rolling toy 100 is rolled along a surface. In the preferred embodiment, the ridge 118 is raised approximately 1 cm from the interior surface 112 and, as illustrated in FIG. 6, has a cross-sectional shape resembling a trapezoid (as viewed along a plane transverse to the helical path followed by the helical ridge 118). In the illustrated embodiment, the helical ridge 118 originates at the second end 108 and terminates at the first end 106. Additionally, in the preferred embodiment, the helical ridge 118 coils around the circumference of the interior surface, i.e. the periphery of the interior surface 112, more than once to define a channel 120 between adjacent convolutions of the helical ridge. That is, the helical ridge 118 winds around the inner surface 112 more than 360 degrees such that two portions of the ridge are adjacent to each other. The channel 120 defines a path along which the balls 102 are further guided during the rolling of the rolling toy 100. More preferably, the helical ridge 118 terminates at the peripheral surface 126 of the passageway 122 in the first end 106 so as to direct a ball 102 moving toward the first end 106 to the passageway 122 when the rolling toy 100 is rolled. As is best illustrated in FIG. 5, the rolling toy 100 also includes an additional ridge 124 that is raised from the interior surface 112 and that further guides the ball 102 toward the passageway 122. The additional ridge 124 originates at a portion of the helical ridge 118 near the first end 106 and terminates at the peripheral surface 126 of the passageway 122, preferably at a location opposite of the location at the peripheral surface where the helical ridge 118 terminates. Hence, when a ball 102 within the interior area 110 is guided toward the first end 106 by the helical ridge 118, the ball will eventually contact the additional ridge 124, which, along with the helical ridge 118, directs the ball into the passageway 122 where it may exit the interior area 110.

As will be appreciated, the helical ridge 118 may be configured in other manners and still be within the confines of the present invention. In alternative embodiments, the helical ridge 118 does not originate at the second end 108, terminate at the first end 106, or wind completely around the circumference of the interior surface 112. For example, the helical ridge 118 may originate at a location spaced from the second end 108, end at a location spaced from the first end 106, and wind only 350 degrees about the circumference of the interior surface 112. As will also be appreciated, an alternative and more challenging embodiment of the rolling toy 100 does not include the additional ridge 124. The helical ridge 118 need not be continuous, but could instead be discontinuous or segmented.

In the preferred embodiment, the rolling toy 100 generates audio output and visual output to further encourage infants to roll the toy, insert balls 102 into the passageway 122, and cause the balls 102 to exit the interior area 110 via the passageway 122. Hence, the preferred embodiment of the rolling toy 100 includes an audio transducer 132 that outputs audible sound waves in the form of musical notes, such as musical compositions and sampled sound effects, as well as a plurality of lights 134 that provide further visual stimuli to an infant playing with the rolling toy 100. In the illustrated embodiment, the audio transducer 132 is a speaker located within a housing or wall 130 that defines the first end 106, and each light 134 is a light emitting diode located along the helical path defined by the helical ridge 118.

As illustrated in FIGS. 1–6, the rolling toy 100 includes another helical ridge 144 that is raised with respect to an exterior surface 128 of the tubular portion 114. The another helical ridge 144 follows the helical path defined by the helical ridge 118 and is located directly adjacent the helical ridge 118. In the preferred embodiment, the another helical ridge 144 is defined by a plurality of molded and translucent curved sections that are attached to the exterior surface 128 of the tubular portion 114 and cover an interior area 148 of the helical ridge 118. As illustrated in FIG. 6, the interior area 148 of the helical ridge 118, as well as the interior area 150 of the another helical ridge 144, accommodate wires 136 that electrically couple the electronic components of the rolling toy 100. The interior areas 148, 150 also house the lights 134, which are equidistantly spaced about the helical curve defined by the helical ridges 118, 144. Hence, the lights 134 are in view when the rolling toy 100 is rolled.

In the preferred embodiment, the audio output of the audio transducer 132 and the visual output of the lights 134 are controlled by a controller 140 that is electrically coupled to the audio transducer 132 and the lights 134 via the wires 136. The operation of the controller 140 is governed by control logic 141, which can be, for example, programmed code. The control logic 141 selects audio content to be output repetitively or non-repetitively, randomly, or in fixed sequences, and/or for a short or long duration of time. The control logic 141 also selects the content, duration, and sequence to be output from the lights 134. In the preferred embodiment, the controller 140 is a printed circuit board having one more programmed microprocessors and memories. It will be appreciated that the many operations of the controller 140 can be completed by any combination of remotely located and different devices that collectively function as the controller 140.

In the preferred embodiment, the rolling toy 100 includes a motion sensor 138 that senses motion of the rolling toy, such as the rolling of the rolling toy across a surface. The motion sensor 138 is coupled to the controller 140 via the wires 136, and sends a signal to the controller when the sensor 138 senses movement of the rolling assembly. In the preferred embodiment, the motion sensor 138 includes a magnetic ball located within a contact ring and directly above a magnet that tends to keep the ball with the contact ring. When the rolling toy 100 is moved, the movement will cause the ball to overcome the force of the magnet and contact the contact ring to trip the motion sensor. Alternative embodiments of the motion sensor 138 are also contemplated. For example, the motion sensor 138 may be a liquid mercury switch or of the type having a raised post surrounded by a spring where movement causes the spring to contact the post to trip the motion sensor. The rolling toy 100 also includes an object sensor 142 that senses when an object, such as the ball 102, is in the passageway 122. The object sensor 142 is also coupled to the controller 140 via the wires 136 and sends a signal to the controller 140 when the object sensor senses that an object is in the passageway 122. In the preferred embodiment, the sensor 142 is a light sensitive component, such as a cadmium sulfide photoresistor (CdS cell) that changes its resistance depending on the amount of light that hits the sensor. This change in resistance then sends a signal to a accompanying transistor that sends a signal to the controller 140. The object sensor 142 is located at the peripheral surface 126 of the passageway 122 and directly across from a light 135, such as an LED, which directs light to the object sensor 142. When an object, such as the ball 102, interrupts the light incident on the object sensor 142 from the light 135, the sensor 142 sends a signal to the controller 140 indicating that an object is in or has passed through the passageway 122. As will be appreciated, the object sensor 142 may take other configurations. For example, the sensor 142 may be a reed switch, a contact switch, or other sensors capable of sensing when an object, such as the ball 102, is in or passes through the passageway 122.

The above-described electronic components of the rolling toy 100 are powered by a power supply 154, such as a battery, which is housed in a compartment and covered with a lid 156 at the second end 108 of the rolling toy 100. The rolling toy 100 also includes a switch 152 via which the electronic components may be turned on and off. The switch 152 also includes two volume settings for setting the volume level from the audio transducer 132.

When an infant plays with the rolling toy 100, the controller 140, in response to receiving a signal from the motion sensor 138, will output audio signals to the audio transducer 132 and video signals to the lights 134 for a predetermined amount of time, after which the audio signals and video signals are no longer output until the motion sensor 138 again senses movement of the rolling toy 100. In the preferred embodiment, the controller 140 will output dual tone music signals for approximately 10 seconds and will activate the lights 134 in sequential order and then deactivate the lights in reverse sequential order. The lights 134 then are controlled to activate in reverse sequential order and then deactivate in sequential order. Thereafter, the lights 134 are repeatedly flashed, and the above-described pattern is repeated until the 10 second duration has passed. Hence, an infant is encouraged to move the rolling toy 100 by hearing and viewing pleasant audio and video content is response to moving the rolling toy 100.

The controller 140 will also output additional audio signals and video signals to the audio transducer 132 and lights 134 in response to receiving a signal from the object sensor 142 indicating that a ball 102 has passed through the passageway 122. These audio signals may be played over, i.e. in addition to, other audio signals if the object sensor 142 is tripped while the controller 140 is outputting audio signals in response to the tripping of the motion sensor 138. In the preferred embodiment, three different sample sound effects (a slide whistle up, a slide whistle down, and a spring sound), may be output by the controller 140 to the audio transducer 132 in response to receiving a signal from the object sensor 142. Each successive signal from the object sensor 142 will cause the controller 140 to output the next sound effect and a light pattern that pulsates to the output sound effect. Hence, when the rolling toy 100 is rolled to such an extent that a ball 102 is guided to the first end 106 and then further guided through the passageway 122, an infant will hear additional pleasing audio and visual output, further encouraging the infant to roll the rolling toy 100 in such a manner that the more balls 102 pass through the passageway 122. When all of the balls have exited the interior area 110 via the passageway 122, the balls 102 may be passed back through the passageway 122 into the interior area 110, and the controller 140 will again output audio signals in response to the sensor 142 sensing the balls 102 passing though the passageway 122.

As is apparent, the integration of the flashing lights and audio content encourages infants to play and crawl along with the rolling toy, encourages patent/child interaction, and helps infants develop motor skills.

Although not preferred, alternative embodiments of the rolling toy 100 do not include electronic components that generate audio and/or visual output. For example, infants may be encouraged to crawl without the added encouragement of electronic audio and video output, such as by watching the spiraling of the helical ridge 144 and movement of the balls 102 within the interior area 110 and through the passageway 122.

The principles, preferred embodiments, and modes of operation of the present invention have been described in the foregoing description. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims be embraced thereby.

What is claimed is:

1. A toy comprising:

a ball;

a tubular assembly having a center axis, a first end, a second end located opposite from said first end, an interior surface facing an interior area of said tubular assembly and located between said first end and said second end, and a helical ridge raised from said interior surface and coiling around a circumference of said interior surface, said first end having a passageway that communicates an area external of said tubular assembly with said interior area and that is sized to permit said ball to pass therethrough, said helical ridge being configured and located to guide said ball away from said first end when said ball moves along said interior surface and said tubular assembly is rolled about said center axis in a first rotational direction, said helical ridge being configured and located to guide said ball toward said first end when said ball moves along said interior surface and said tubular assembly is rolled about said center axis in a second rotational direction opposite from said first rotational direction; a motion sensor for sensing rolling movement of said tubular assembly; at least one of a light and an audio transducer; and a controller configured to activate at least one of said light and said motion sensor in response to said motion sensor sensing rolling movement of said tubular assembly.

2. The toy of claim 1, said helical ridge originating at said second end and ending at said first end.

3. The toy of claim 1, said helical ridge coiling around said circumference a plurality of times to define a channel located between adjacent convolutions of said helical ridge.

4. The toy of claim 1, said first end being closed off to prevent said ball from exiting said tubular assembly at said first end except through said passageway.

5. The toy of claim 4, said passageway having a peripheral surface, said helical ridge ending at said peripheral surface.

6. The toy of claim 4, said tubular assembly further comprising another ridge raised from said interior surface, said another ridge originating at said helical ridge and following a path toward said passageway.

7. The toy of claim 6, said passageway having a peripheral surface, said another ridge ending at said peripheral surface.

8. The toy of claim 4, said passageway having an oval peripheral surface.

9. The toy of claim 4, said second end being closed off to prevent said ball from exiting said tubular assembly at said second end.

10. The toy of claim 1, at least a portion of said interior surface being transparent.

11. The toy of claim 1, said tubular assembly further comprising another sensor for sensing when said ball is in said passageway.

12. The toy of claim 11, said tubular assembly including said audio transducer said controller being coupled to said another sensor and said audio transducer, said controller being configured to send audio signals to said audio transducer in response to said another sensor sensing said ball.

13. The toy of claim 11, said tubular assembly including a plurality of lights, said light being one of said plurality of lights, said controller being coupled to said another sensor and said lights, said controller being configured to activate said lights in response to said another sensor sensing said ball.

14. The toy of claim 13, said tubular assembly including another helical ridge raised from an exterior surface of said tubular assembly and coiling around a circumference of said exterior surface.

15. The toy of claim 14, at least one of said helical ridge raised from said interior surface and said another helical ridge raised from said exterior surface including a hollow interior area, at least some of said plurality of lights being located within said hollow interior area.

16. The toy of claim 13, said plurality of lights including light emitting diodes.

17. The toy of claim 1, said passageway having a peripheral surface that is located substantially tangential with respect to said interior surface.

18. A toy comprising:

a ball;

a tubular assembly having a center axis, a first end, a second end located opposite from said first end, an interior surface facing an interior area of said tubular assembly and located between said first end and said second end, said first end having a passageway that communicates an area external of said tubular assembly with said interior area and that is sized to permit said ball to pass therethrough, said tubular assembly further comprising means for guiding said ball toward said first end when said ball moves along said interior surface and said tubular assembly is rolled about said center axis.

19. A toy comprising:

a tubular assembly having a first end, a second end located opposite from said first end, an interior surface facing an interior area of said tubular assembly and located between said first end and said second end, a helical ridge raised from said interior surface and coiling around a circumference of said interior surface, a passageway passing through a wall of said first end, a sensor that senses when an object is located in said passageway, an audio transducer, and a controller coupled to said sensor and said audio transducer and that sends audio signals to said audio transducer in response to said sensor sensing the object in said passageway.

20. The toy of claim 19, said helical ridge originating at said second end and ending at said first end.

21. The toy of claim 19, said helical ridge coiling around said circumference a plurality of times to define a channel located between adjacent convolutions of said helical ridge.

22. The toy of claim 19, said passageway having a peripheral surface, said helical ridge originating at said second end and ending at said peripheral surface.

23. The toy of claim 19, said tubular assembly further comprising another ridge raised from said interior surface, said another ridge originating at said helical ridge and following a path toward said passageway.

24. The toy of claim 19, said passageway having a peripheral surface that is located substantially tangential with respect to said interior surface.

25. The toy of claim 19, at least a portion of said interior surface being transparent.

26. The toy of claim 19, said tubular assembly further comprising a plurality of lights, said controller being coupled to said plurality of lights and being configured to activate said plurality of lights in response to said sensor sensing the object in said passageway.

27. The toy of claim 26, said plurality of lights including a plurality of light emitting diodes.

28. The toy of claim 19, said tubular assembly further comprising a motion sensor for sensing movement of said tubular assembly, said controller being coupled to said motion and being configured to send additional audio signals to said audio transducer in response to said motion sensor sensing movement of said tubular assembly.

* * * * *